US007552828B2

(12) United States Patent
Fügel

(10) Patent No.: US 7,552,828 B2
(45) Date of Patent: Jun. 30, 2009

(54) SUPPORTING BRACKET FOR MOBILE MACHINE TOOLS

(75) Inventor: Dietmar Fügel, Wolfschlugen (DE)

(73) Assignee: Putzmeister Concrete Pumps GmbH, Aichtal (DE)

( * ) Notice: Subject to any disclaimer, the term of this patent is extended or adjusted under 35 U.S.C. 154(b) by 0 days.

(21) Appl. No.: 11/884,248

(22) PCT Filed: Jan. 21, 2006

(86) PCT No.: PCT/EP2006/000532

§ 371 (c)(1),
(2), (4) Date: Aug. 13, 2007

(87) PCT Pub. No.: WO2006/087068

PCT Pub. Date: Aug. 24, 2006

(65) Prior Publication Data

US 2008/0142464 A1 Jun. 19, 2008

(30) Foreign Application Priority Data

Feb. 17, 2005 (DE) ..... 10 2005 007 522

(51) Int. Cl.
*B66C 23/78* (2006.01)

(52) U.S. Cl. ..... 212/302; 180/766.1

(58) Field of Classification Search ..... 280/766.1; 212/302–304

See application file for complete search history.

(56) References Cited

U.S. PATENT DOCUMENTS

| | | | | |
|---|---|---|---|---|
| 2,776,148 | A * | 1/1957 | Geerds | 280/766.1 |
| 3,062,385 | A * | 11/1962 | Thompson | 280/766.1 |
| 3,871,685 | A * | 3/1975 | Senelet | 280/766.1 |
| 3,901,532 | A * | 8/1975 | Hornagold | 280/766.1 |
| 4,067,595 | A * | 1/1978 | Vigerie | 280/766.1 |
| 4,266,679 | A | 5/1981 | Juergens | |
| 5,624,046 | A * | 4/1997 | Zimmermann | 212/349 |
| 5,758,785 | A * | 6/1998 | Spinosa et al. | 212/300 |
| 6,840,540 | B2 | 1/2005 | Fügel | |

FOREIGN PATENT DOCUMENTS

| | | | |
|---|---|---|---|
| DE | 26 27 744 | A1 | 12/1977 |
| DE | 33 15 753 | A1 | 10/1984 |
| DE | 100 32 622 | A1 | 1/2002 |
| DE | 201 20 964 | U1 | 7/2003 |
| EP | 0 072 697 | A1 | 2/1983 |
| GB | 2 368 706 | A | 5/2002 |

OTHER PUBLICATIONS

International Search Report.

* cited by examiner

*Primary Examiner*—Thomas J. Brahan
(74) *Attorney, Agent, or Firm*—Collard & Roe, P.C.

(57) ABSTRACT

The invention relates to a supporting bracket (38) of a supporting construction for mobile machine tools, especially for concrete pumps. The supporting bracket (38) is multi-telescopic and comprises a carriage (38) which is pivotably arranged on the chassis (10), and a telescopic part consisting of a plurality of telescopic segments (40', 40", 40''') which are guided inside each other, engage in the carriage, and are mobile in relation thereto. The aim of the invention is to provide a narrow support using simple means. To this end, the carriage (38) and at least some of the telescopic segments (40", 40''') have coupling points (50', 50", 50''') on which the segments can be coupled in pairs in such a way as to produce a fixed connection when the segments are retracted in relation to each other.

8 Claims, 3 Drawing Sheets

Figure 1A:
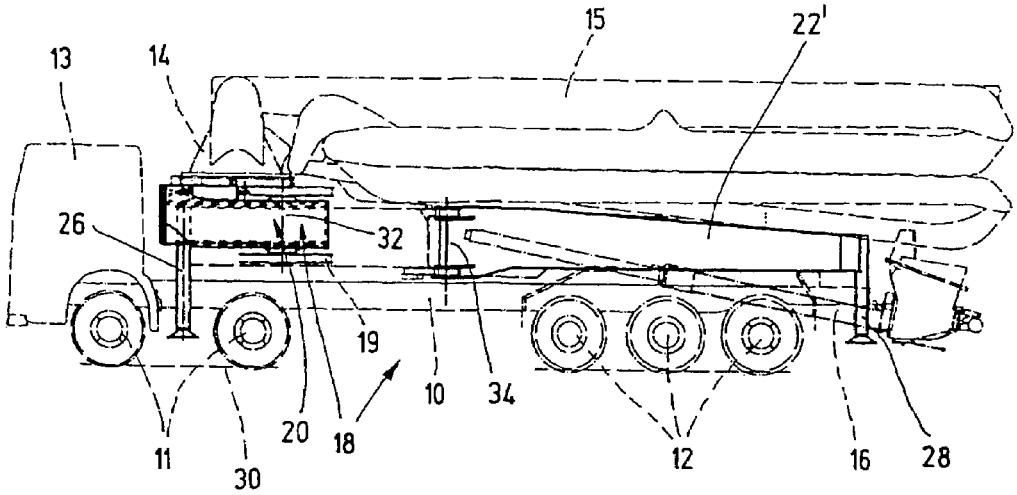

40'''
40''
40'
40
20
38
50'''
56
50'
56
50''
54
52
53
26
30

20
40'
38
40'''
40''
50
54
50''
52
50'
50'''
56
54
50''
52
53
50'
26
30

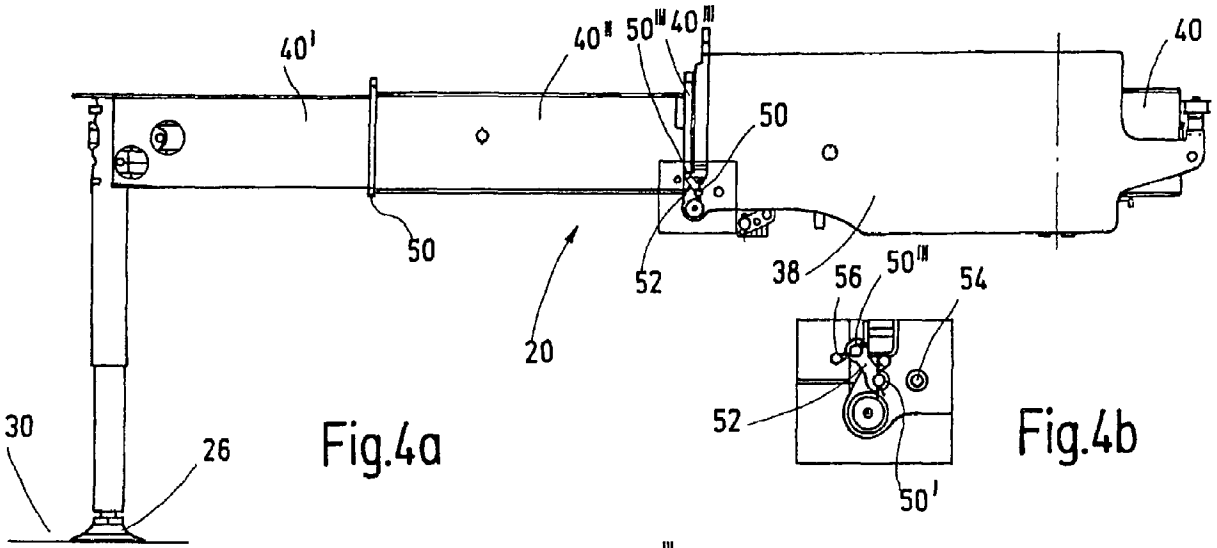
Fig.4a
Fig.4b
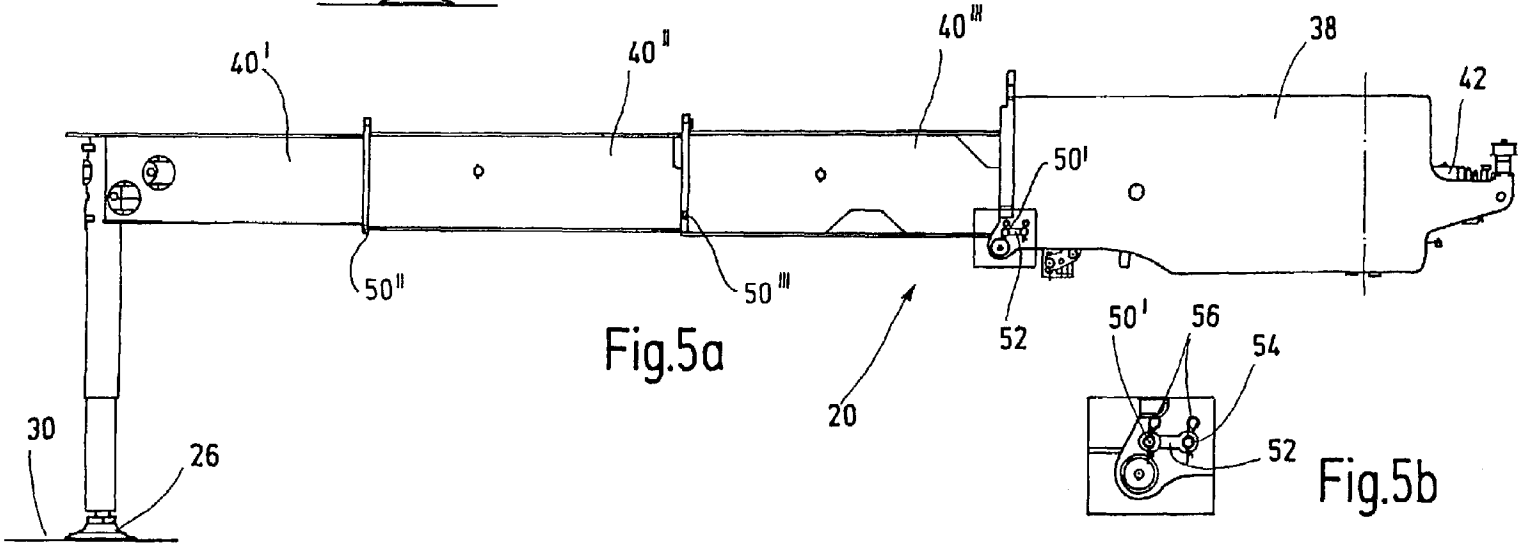
Fig.5a
Fig.5b

SUPPORTING BRACKET FOR MOBILE MACHINE TOOLS

CROSS REFERENCE TO RELATED APPLICATIONS

Applicant claims priority under 35 U.S.C. §119 of German Application No. 10 2005 007 522.3 filed Feb. 17, 2005. Applicant also claims priority under 35 U.S.C. §365 of PCT/EP2006/000532 filed Jan. 21, 2006. The international application under PCT article 21(2) was not published in English.

The invention relates to a support boom for mobile work machines, particularly for mobile concrete pumps, having a push-out box disposed on a chassis, preferably so as to pivot, having a telescope part consisting of several telescope segments guided inside one another, which engages into the push-out box, and having a foot part disposed on the front end of the first telescope segment, preferably adjustable vertically.

In the case of mobile concrete pumps, it is known (DE-A-10032622) to configure at least one part of the support boom as a multiple telescope, which engages into a push-out box that can pivot relative to the chassis and is displaceable relative to the latter. In the operating state, the telescope segments are always completely extended there. A narrow support on construction sites that have limited space is brought about in that the set-up angle of the support boom relative to the chassis is reduced in size.

Proceeding from this, the invention is based on the task of improving the known support booms of the type indicated initially in such a manner that a further possibility of narrow support is obtained, which can be adjusted in simple and reliable manner during the set-up process.

To accomplish this task, the combination of characteristics indicated in claim 1 is proposed. Advantageous embodiments and further developments are evident from the dependent claims.

The solution according to the invention is based on the thought that during the set-up process, only part of the telescope segments is extended, and the other segments remain in their retracted position. In order to ensure, in the case of such set-up, that individual telescope segments do not get into a mechanically unstable position in which they are only partly extended, it is proposed, according to the invention, that the push-out box and at least part of the telescope segments have coupling points at which they can be coupled with one another, in pairs, in the state in which they are retracted, relative to one another, producing a connection that is resistant to displacement. With this measure, the result is achieved that during the set-up process, individual telescope segments are either extended completely or remain completely in their retracted position.

A preferred embodiment of the invention provides that the coupling points are disposed in the region of the front end of the push-out box and at least of a part of the telescope segments. It is practical if the coupling points have a defined distance from one another in the retracted state of the telescope segments, so that a coupling member can be used for connecting them, which member is configured in such a manner that it can be coupled with two selected coupling points, in each instance, producing the connection that is resistant to displacement.

Another preferred structural embodiment of the invention provides that coupling pins are disposed at the coupling points, which have a defined distance from one another in the retracted state of the telescope segments, in pairs, and that the coupling member has the shape of a tab having two recesses disposed at the distance of the coupling pins from one another, for being set onto selected coupling pins.

In order to be able to accommodate the coupling member so that it cannot come loose, even when it is not in use, it is practical if the push-out box has another holder pin for the coupling member, which pin is disposed at a defined distance from the related coupling pin. The coupling and holder pins can have a crosswise bore for accommodating a locking element, preferably configured as a spring plug.

Figure 1B:
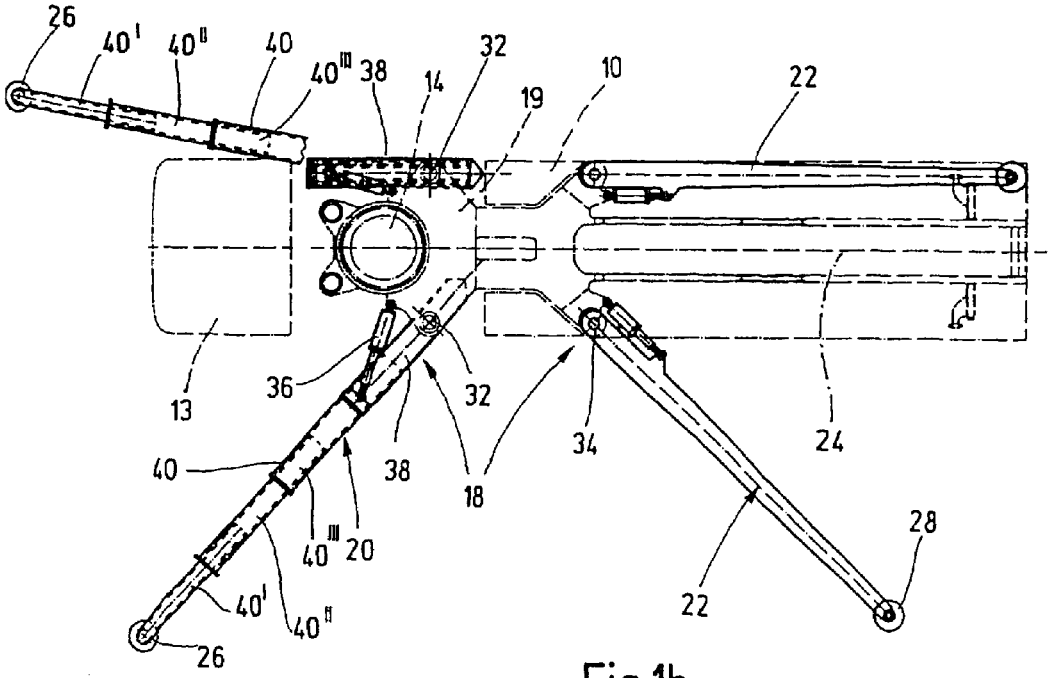
Figures 2A, 2B, 3A, 3B:
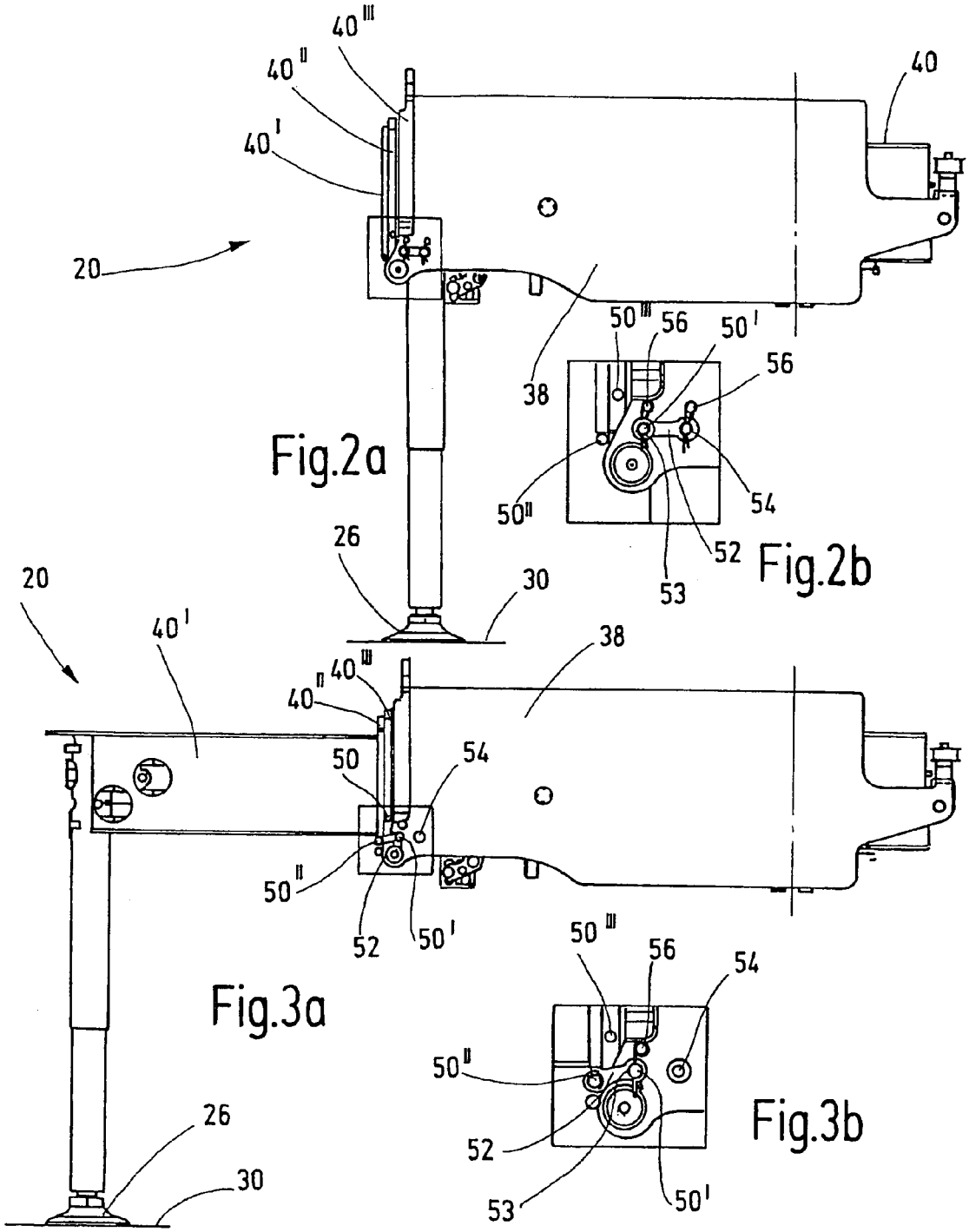

In the following, the invention will be explained in greater detail using an exemplary embodiment shown schematically in the drawing. This shows:

FIG. 1*a* a side view of a mobile concrete pump with support booms in the transport position;

FIG. 1*b* a top view of the mobile concrete pump with support booms in various positions;

FIGS. 2*a* and *b*, a side view of a front support boom in the retracted state, as well as an enlarged detail of the coupling region;

FIGS. 3*a* and *b*, a side view of the support boom with the first telescope segment extended, as well as an enlarged detail of the coupling region;

FIGS. 4*a* and *b*, a side view of the support boom with the first and second telescope segment extended, as well as an enlarged detail of the coupling region;

FIGS. 5*a* and *b*, a side view of the support boom with the telescope segments completely extended, as well as an enlarged detail of the coupling region.

The mobile concrete pump shown in FIGS. 1*a* and *b* essentially consists of a multi-axle chassis 10 having two front axles 11 and three rear axles 12, having a driver's cabin 13, a concrete distributor mast 15 mounted on a rotation mechanism 14 close to the front axle, so as to rotate about a vertical axis, having a pump arrangement 16 mounted on the chassis 10 at a distance from the rotation mechanism 14, as well as a support construction 18 for the chassis 10. The support construction 18 has a support frame 19 fixed to the chassis, and comprises two front support booms 20 and two rear support booms 22, which are drawn in, in the transport position, and oriented parallel to the longitudinal axis 24 of the vehicle, and, in the support position, project beyond the chassis 10 to the front and to the rear, respectively, and are supported on the ground 30 with their foot parts 26, 28.

The front support booms 20 can be pivoted about their vertical pivot axles 32, and the rear support booms 22 can be pivoted about their vertical pivot axles 34, between the transport position and the support position, under the effect of a set-up cylinder 36, in each instance.

The front support booms 20 are configured as telescope booms. They comprise a push-out box 38 that can pivot relative to the chassis, about the vertical pivot axle 32, in each instance, and a telescope part 40 consisting of three telescope segments 40', 40", 40'". A dual-action hydro-cylinder 42 that can telescope multiple times extends through the push-out box 38 and the telescope part 40.

A particular feature of the telescoping support boom 20 consists in the fact that the telescope segments 40', 40", 40'" can be extended to a stop, also individually (cf. FIG. 3*a* to 5*a*). For this purpose, the push-out box 38 and the two telescope segments 40", 40'" have a coupling point configured as coupling pins 50', 50", 50'", in each instance, at which they can be coupled with one another, in pairs, in the state in which they are retracted relative to one another, producing a displaceable connection (FIGS. 3*b* and 4*b*). Coupling takes place using a tab-shaped coupling member 52 that has two recesses 53 disposed at a distance from one another, and that can be coupled with two selected coupling pins 50', 50" or 50', 50'", in each instance, producing a connection that is resistant to displacement.

Another holder pin 54 on the push-out box ensures that the coupling member can be fixed in place on the push-out box so as not to come loose, when it is not in use. The coupling pins 50', 50", 50'" furthermore have a cross-bore into which a locking element configured as a spring plug 56 can be inserted, to secure the coupling member 52. In the positions shown in FIGS. 2*a* and *b*, as well as 5*a* and *b*, the coupling member is in its holding position, in which it has no function, and in which it is held so as not to come loose. In this position of the coupling member, the telescope segments 40', 40", 40'" can be displaced from the retracted end position shown in FIGS. 2*a* and *b* into the completely extended end position shown in FIGS. 5*a* and *b*.

In the state of FIGS. 3*a* and *b*, the coupling member 52 extends between the coupling pin 50' on the push-out box and 50" at the free end of the second telescope segment 40". Accordingly, in this state, only the first telescope segment 50' can be extended, while the telescope segments 50" and 50'" are held in place in their retracted position.

In the case of the arrangement shown in FIGS. 4*a* and *b*, in which the coupling member 52 extends between the coupling pins 50' and 50'", the two telescope segments 40' and 40" can be extended, while the telescope segment 40'" is held in place in its retracted position, by way of the coupling member 52.

The coupling members 52 are set onto the coupling pins by the pump driver, as needed, before the support booms are extended, in one of the selected positions. In this way, it is possible to set one of the three extension positions for the subsequent extension process, as shown in FIGS. 3*a*, 4*a*, and 5*a*, in simple and reliable manner. Undesirable intermediate positions of the telescope booms are precluded. Fundamentally, it would also be possible to affix the coupling member between the two coupling pins 50", 50'". In this case, only the first and the third telescope segments 40', 40'" can be extended during the extension process, while the second telescope segment 40" would remain in its retracted position within the third telescope segment 40'".

In summary, the following should be stated: The invention relates to a support boom 38 of a support construction for mobile work machines, particularly for mobile concrete pumps. The support boom 38 can telescope multiple times and has a push-out box 38 that is disposed so as to pivot on the chassis 10, as well as a telescope part that consists of several telescope segments 40', 40", 40'" that are guided in one another, which part engages into the push-out box and is displaceable relative to the latter.

In order to be able to bring about narrow support with simple means, the push-out box 38 and at least part of the telescope segments 40", 40'" have coupling points 50', 50", 50'" at which they can be coupled with one another, in pairs, in the state in which they are retracted relative to one another, producing a connection that is resistant to displacement.

The invention claimed is:

1. A support construction for mobile concrete pumps, comprising at least two support booms, each support boom having a chassis, a push-out box disposed on the chassis, said push-out box having a telescopic part engaging into the push-out box, said telescopic part comprising at least first and second telescopic segments movable in relation to the chassis, one of said at least first and second telescopic segments being guided inside another of said first and second telescopic segments, a foot part disposed on a front end of the first telescopic segment, a plurality of coupling pins, and a coupling member, wherein the push-out box and at least part of the telescopic segments have coupling points on which the first telescopic segment can be coupled with the second telescopic segment so as to produce a fixed connection when the segments are retracted in relation to each other, wherein the coupling pins are disposed at the coupling points, the coupling points having a defined distance from each other in a retracted state of the telescopic segments, and wherein the coupling member has first and second recesses disposed at a distance from each other corresponding to the distance of the coupling pins from each other to permit the coupling member to be set onto selected coupling pins.

2. A mobile concrete pump, comprising a support construction comprising at least two support booms, each support boom having a chassis, a push-out box disposed on the chassis, said push-out box having a telescopic part engaging into the push-out box, said telescopic part comprising at least first and second telescopic segments movable in relation to the chassis, one of said at least first and second telescopic segments being guided inside another of said first and second telescopic segments, a foot part disposed on a front end of the first telescopic segment, a plurality of coupling pins, and a coupling member, wherein the push-out box and at least part of the telescopic segments have coupling points on which the first telescopic segment can be coupled with the second telescopic segment so as to produce a fixed connection when the segments are retracted in relation to each other, wherein the coupling pins are disposed at the coupling points, the coupling points having a defined distance from each other in a retracted state of the and second recesses disposed at a distance from each other corresponding to the distance of the coupling pins from each other to permit the coupling member to be set onto selected coupling pins.

3. A support boom for a mobile work machine comprising:

(a) a chassis;

(b) a push-out box disposed on the chassis, said push-out box having a telescopic part engaging into the push-out box, said telescopic part comprising at least first and second telescopic segments movable in relation to the chassis, one of said at least first and second telescopic segments being guided inside another of said first and second telescopic segments;

(c) a foot part disposed on a front end of the first telescopic segment;

(d) a plurality of coupling pins; and (e) a coupling member;

wherein the push-out box and at least part of the telescopic segments have coupling points on which the first telescopic segment can be coupled with the second telescopic segment so as to produce a fixed connection when the segments are retracted in relation to each other;

wherein the coupling pins are disposed at the coupling points, the coupling points having a defined distance from each other in a retracted state of the telescopic segments; and wherein the coupling member has first and second recesses disposed at a distance from each other corresponding to the distance of the coupling pins from each other to permit the coupling member to be set onto selected coupling pins.

4. The support boom according to claim 3, wherein the coupling points are disposed in the region of the front end of the push-out box and at least of a part of the telescopic segments.

5. The support boom according to claim 3, wherein the coupling member can be coupled with two selected coupling points in each instance, producing the fixed connection.

6. The support boom according to claim 3, wherein the push-out box has a holder pin for the coupling member, which pin is disposed at a defined distance from the coupling pin on the push-out box side.

7. The support boom according to claim 3, wherein the coupling pins have a crosswise bore for accommodating a locking element.

8. The support boom according to claim 3, wherein the coupling member has the shape of a tab having two recesses disposed at a distance from one another.

* * * * *

UNITED STATES PATENT AND TRADEMARK OFFICE

CERTIFICATE OF CORRECTION

PATENT NO. : 7,552,828 B2
APPLICATION NO. : 11/884248
DATED : June 30, 2009
INVENTOR(S) : Fügel It is certified that error appears in the above-identified patent and that said Letters Patent is hereby corrected as shown below:

In particular, in Column 4, line 29, (Line 18 of Claim 2) after the word "the" please add:

--telescopic segments, and wherein the coupling member has first--.

Signed and Sealed this

Twenty-fifth Day of August, 2009

David J. Kappos

David J. Kappos
*Director of the United States Patent and Trademark Office*